US006168099B1

(12) United States Patent
Hopf et al.

(10) Patent No.: US 6,168,099 B1
(45) Date of Patent: Jan. 2, 2001

(54) METHOD AND DEVICE FOR PRODUCING A PERFORATED DISC FOR AN INJECTOR VALVE, PERFORATED DISC FOR AN INJECTOR VALVE AND INJECTOR VALVE

(75) Inventors: Wilhelm Hopf, Sachsenheim; Kurt Schreier, Schorndorf; Siegfried Goppert, Zapfendorf; Kurt Schraudner, Bamberg; Henning Teiwes, Hallstadt; Jörg Heyse, Markgröningen; Dieter Holz, Affalterbach, all of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/230,938

(22) PCT Filed: Mar. 17, 1998

(86) PCT No.: PCT/DE98/00784

§ 371 Date: Feb. 3, 1999

§ 102(e) Date: Feb. 3, 1999

(87) PCT Pub. No.: WO98/57060

PCT Pub. Date: Dec. 17, 1998

(30) Foreign Application Priority Data

Jun. 7, 1997 (DE) ..... 197 24 075

(51) Int. Cl.[7] ..... F02M 61/00
(52) U.S. Cl. ..... 239/596; 239/600; 29/17.3
(58) Field of Search ..... 239/585.1, 585.3, 239/596, 900; 29/17.3, 412

(56) References Cited

U.S. PATENT DOCUMENTS

| | | | | |
|---|---|---|---|---|
| 4,854,024 | | 8/1989 | Bata et al. . | |
| 4,923,169 | | 5/1990 | Grieb et al. . | |
| 5,335,864 | * | 8/1994 | Romann et al. | 239/585.1 |
| 5,350,119 | | 9/1994 | Bergstrom . | |
| 5,435,884 | | 7/1995 | Harvey et al. . | |
| 5,484,108 | | 1/1996 | Nally . | |
| 5,540,387 | * | 7/1996 | Reiter et al. | 239/596 X |
| 5,570,841 | | 11/1996 | Pace et al. . | |
| 5,766,441 | * | 6/1998 | Arndt et al. | 239/596 X |
| 5,785,254 | * | 6/1998 | Zimmermann et al. | 239/900 X |
| 5,862,991 | * | 6/1998 | Willke et al. | 239/900 X |

FOREIGN PATENT DOCUMENTS

| | | |
|---|---|---|
| 41 23 692 | 1/1993 | (DE) . |
| 196 07 288 | 10/1996 | (DE) . |
| 195 22 284 | 1/1997 | (DE) . |

OTHER PUBLICATIONS

Patent Abstracts of Japan, vol. 098, No. 005, Apr. 30, 1998 & JP 10 018943 (Aisan Ind. Co. Ltd.) Jan. 20, 1998*.

* cited by examiner

*Primary Examiner*—Lesley D. Morris
(74) *Attorney, Agent, or Firm*—Kenyon & Kenyon

(57) ABSTRACT

A method is provided for manufacturing an orifice disk. Metal foils are made available, opening geometries and auxiliary openings are introduced in the metal foils. The individual metal foils are superimposed in centered fashion. The metal foils are joined using a joining method, thus creating an orifice disk band having a plurality of rounds. Finally an isolation of the rounds or orifice disks is performed.

The orifice disks manufactured in this manner are particularly suitable for use in fuel injection valves that are utilized in mixture-compressing, spark-ignited internal combustion engines.

38 Claims, 9 Drawing Sheets

FIG. 3
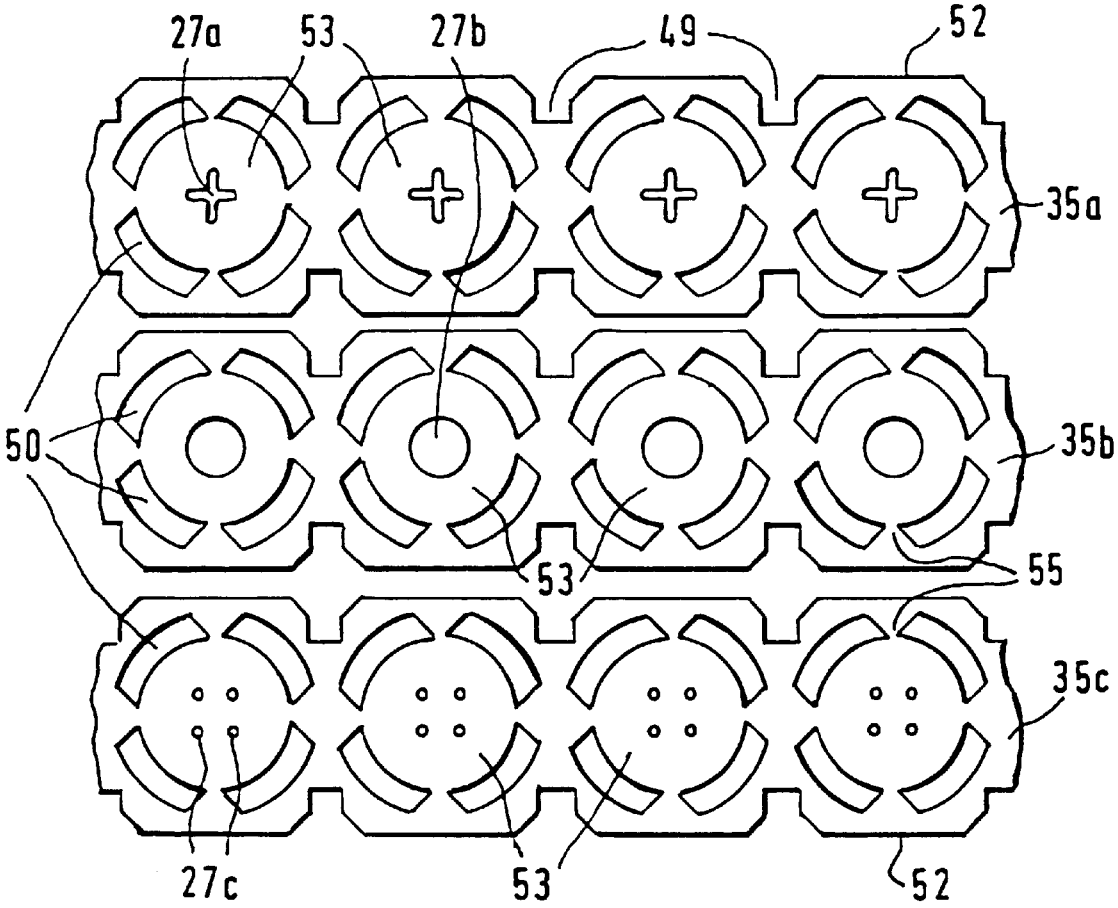
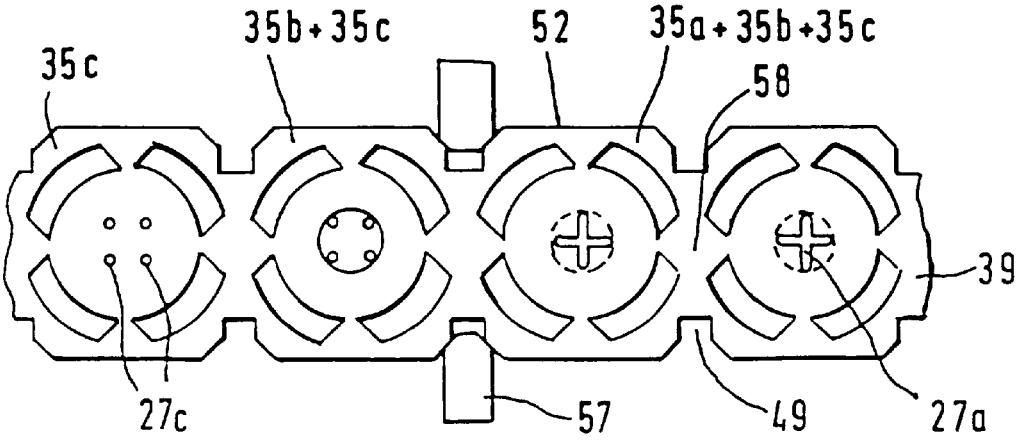
FIG. 4

FIG.8
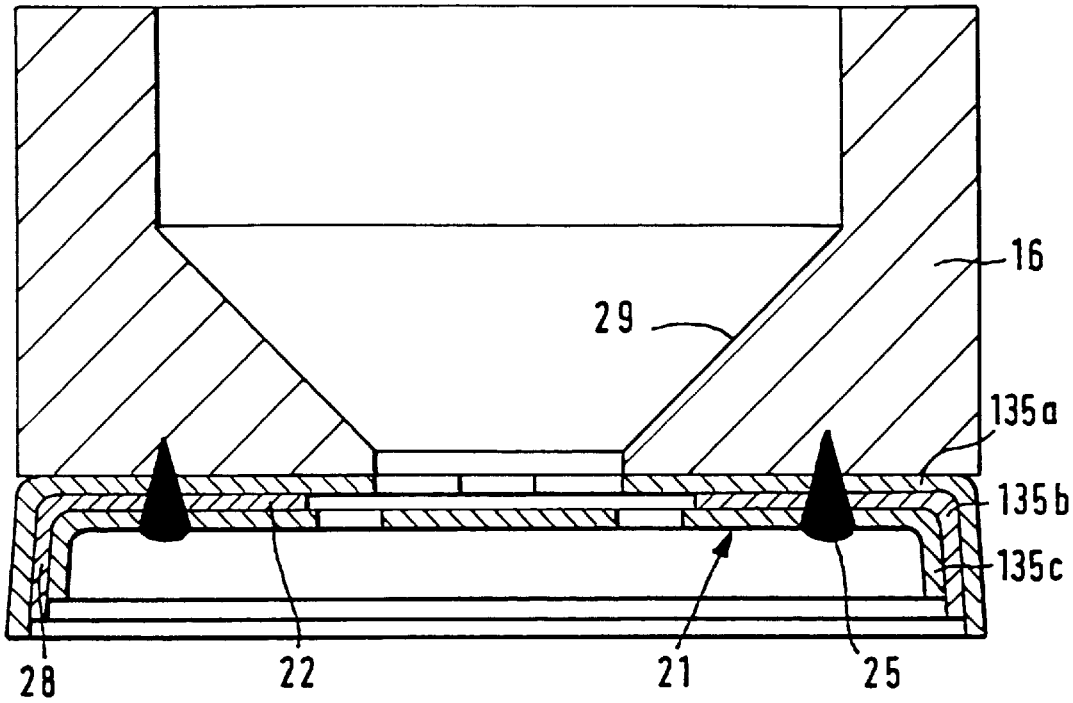
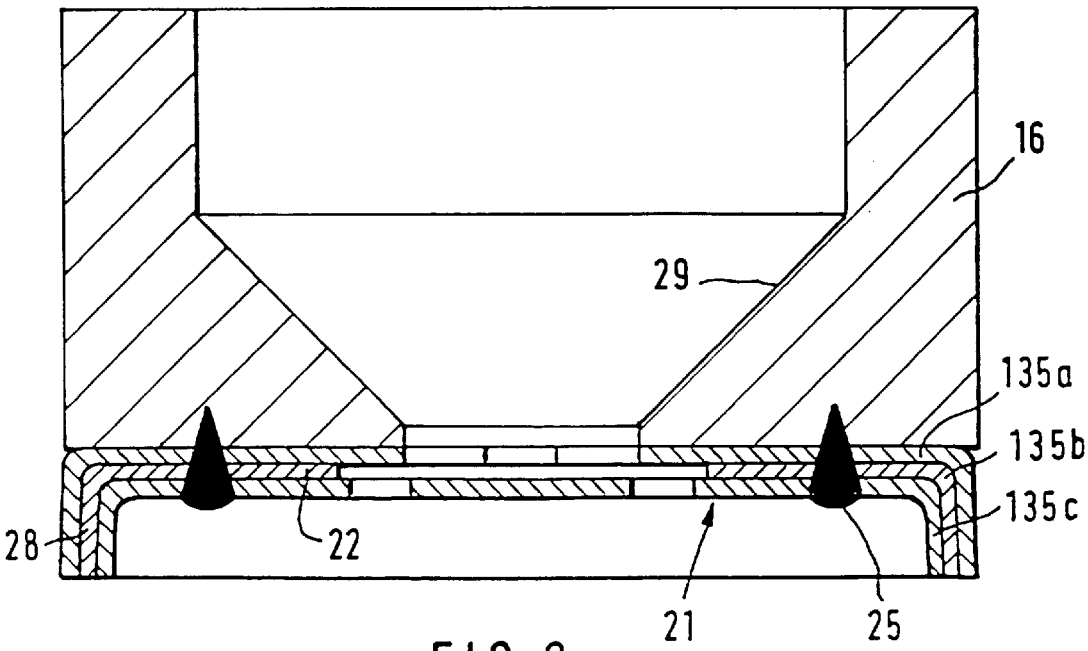
FIG.9

METHOD AND DEVICE FOR PRODUCING A PERFORATED DISC FOR AN INJECTOR VALVE, PERFORATED DISC FOR AN INJECTOR VALVE AND INJECTOR VALVE

FIELD OF THE INVENTION

The present invention relates to a method for manufacturing an orifice disk for an injection valve.

BACKGROUND INFORMATION

U.S. Pat. No. 4,854,024 describes a method for manufacturing a multi-stream orifice plate for a fuel injection valve in which a thin metal stock is used. Orifices, which can be further processed by subsequent pressing or coining, are introduced into the stock by punching. Circular orifice plates are then punched out from the stock around the orifices, thus yielding the orifice plates in isolated form. U.S. Pat. No. 4,854,024 and U.S. Pat. No. 4,923,169 describes the use of a maximum of two such orifice plates manufactured in this fashion in a sandwiched manner on a fuel injection valve. For this purpose, the two metal layers of an orifice plate of this kind, present independently of one another, are clamped one on top of another between a valve seat element and a support ring that is to be attached in positive fashion. Each individual metal layer of a two-layer orifice plate of this kind is thus manufactured entirely separately, so that a multi-layer orifice plate is created on the injection valve only in the directly installed state. Lastly, the support ring must again be mounted in the valve seat support by crimping or another fitting method, since it alone does not result in any immobilization of the orifice plate.

U.S. Pat. No. 5,570,841 describes orifice disks, comprising several layers, which are used in fuel injection valves. The two or four layers of the orifice disks are again manufactured separately from stainless steel or silicon, and have openings and channels serving as opening geometries, which are shaped by electrodischarge machining, electrodeposition, etching, precision punching, or micromachining. The layer provided farthest away from the valve seat always possesses an opening geometry which imparts a swirl component to the medium flowing through. The layers, manufactured independently from one another, form the multi-layer sandwich-like orifice disk only when located directly on the injection valve, since the individual layers are clamped in, stacked one above another, between the valve seat element and a support disk.

U.S. Pat. No. 5,484,108, describes orifice disk elements for fuel injection valves which comprise two or three thin layers of a suitable metal, for example a stainless steel. Here again, the layers of the orifice disk element are manufactured separately from one another, being shaped in such a way that, resting in sandwich fashion one above another, they cause the creation of at least one cavity-forming chamber in the region of their opening geometries. In the same fashion as in the documents already mentioned above, the individual layers of the orifice disk element are clamped between the valve seat element and a support member.

U.S. Pat. No. 5,350,119 describes a fuel injection valve which has a clad orifice disk element. The orifice disk element is manufactured from a strip of a refractory metal such as molybdenum, and a coating, resting thereupon, of a soft metal such as copper. The flat layers of the orifice disk element are retained on the valve seat element by crimping over the valve seat support.

SUMMARY OF THE INVENTION

The methods according to the present invention for manufacturing an orifice disk, have the advantage that by applying them it is possible, in a simple manner and very effectively, to manufacture multi-layer metal orifice disks economically and in very large volumes (assembly-line production). In particularly advantageous fashion, a simple and economical positional allocation of individual metal foils or of the metal layers of the later orifice disks is achieved by auxiliary openings, so that production reliability is very high. The positional allocation of the metal foils can advantageously be accomplished automatically via optical scanning and image analysis. On machines and automatic devices for the manufacture of multi-layer orifice disks, the material, metal thickness, desired opening geometries, and other parameters can be ideally adapted for the particular application.

It is particularly advantageous to make the metal foils available in the form of foil strips or foil carpets for further processing.

Advantageously, the metal foils are made available in rolled-up form, since optimum space utilization on a production line is thereby possible.

It is particularly advantageous to provide on the edges of the metal foils, at regular intervals, auxiliary openings into which centering mechanisms can engage, in order to ensure that the individual metal foils are brought together in positionally accurate fashion. It is moreover very advantageous if sickle-shaped auxiliary openings, which with their inner boundaries define the diameter of the rounds that represent the orifice disk blanks and are to be detached from the metal foils, are introduced into the metal foils. These auxiliary openings taper to a point at their ends, and are separated from the respective nearest auxiliary opening only by a very narrow web. Upon subsequent punching, deep-drawing, or cupping, these webs break, thus isolating the rounds or orifice disks from the orifice disk strip.

Welding, soldering, or adhesive bonding, in all their various forms of application, ideally serve as joining methods to be used optionally to join several metal foils within or outside the rounds.

In particularly advantageous fashion, isolation of the rounds and bending of the rounds into cup-shaped orifice disks is accomplished in a deep drawing tool in one and the same processing step.

The orifice disk according to the present invention has the advantage of being very easy to manufacture, and very easy and economical to install on an injection valve. The embodiments according to the present invention of the multi-layer orifice disks completely prevent any sliding of individual layers against one another. Despite its multi-layer configuration, an orifice disk of this kind is inherently entirely stable and can be attached in an easily handled fashion. Advantageously, a retaining rim bent away from the base part of the orifice disk is suitable for attachment to a valve seat support using a weld bead. Support elements, such as support disks or support rings, are not necessary when securing the orifice disk.

The injection valve according to the present invention having has the advantage that uniform ultrafine atomization of the medium to be sprayed is achieved in simple fashion without additional energy, a particularly high atomization quality, and spray shaping adapted to the particular requirements, being attained. This is attained, advantageously, by the fact that an orifice disk arranged downstream from a valve seat has an opening geometry for complete axial passage of the medium, in particular of the fuel, which is delimited by a valve seat element surrounding the fixed valve seat. The valve seat element thus already assumes the function of influencing flow in the orifice disk.

In particularly advantageous fashion, an S-bend is achieved in the flow in order to improve atomization of the fuel, since the valve seat element covers, with one lower end face, the spray openings of the orifice disk.

The S-bend in the flow attained by way of the geometrical arrangement of valve seat element and orifice disk allows the creation of spray shapes with high atomization quality. In conjunction with correspondingly embodied valve seat elements for single-, double-, and multi-stream sprays, the orifice disks make possible spray cross sections in innumerable variants, for example rectangles, triangles, crosses, and ellipses. Unusual spray shapes of this kind allow exact optimal adaptation to predefined geometries, for example to different intake manifold cross sections of internal combustion engines. This yields the advantages of geometrically adapted utilization of the available cross section for homogeneously distributed, emissions-reducing mixture delivery, and avoidance of emissions-promoting wall film deposits on the intake manifold wall. With an injection valve of this kind, the exhaust gas emissions of the internal combustion engine can consequently be reduced and a decrease in fuel consumption can also be attained.

In very general terms, the fact that spray profile variations are possible in a simple fashion may be regarded as a very significant advantage of the injection valve according to the present invention.

BRIEF DESCRIPTION OF DRAWINGS

FIG. 3 shows exemplary embodiments of foil strips for manufacturing a three-layer orifice disk.

FIG. 4 shows an orifice disk strip having several superposed foil strips.

FIG. 8 shows a second example of a deep-drawn orifice disk mounted on a valve seat element.

FIG. 9 shows a third example of a deep-drawn orifice disk mounted on a valve seat element.

DETAILED DESCRIPTION

Figure 1:
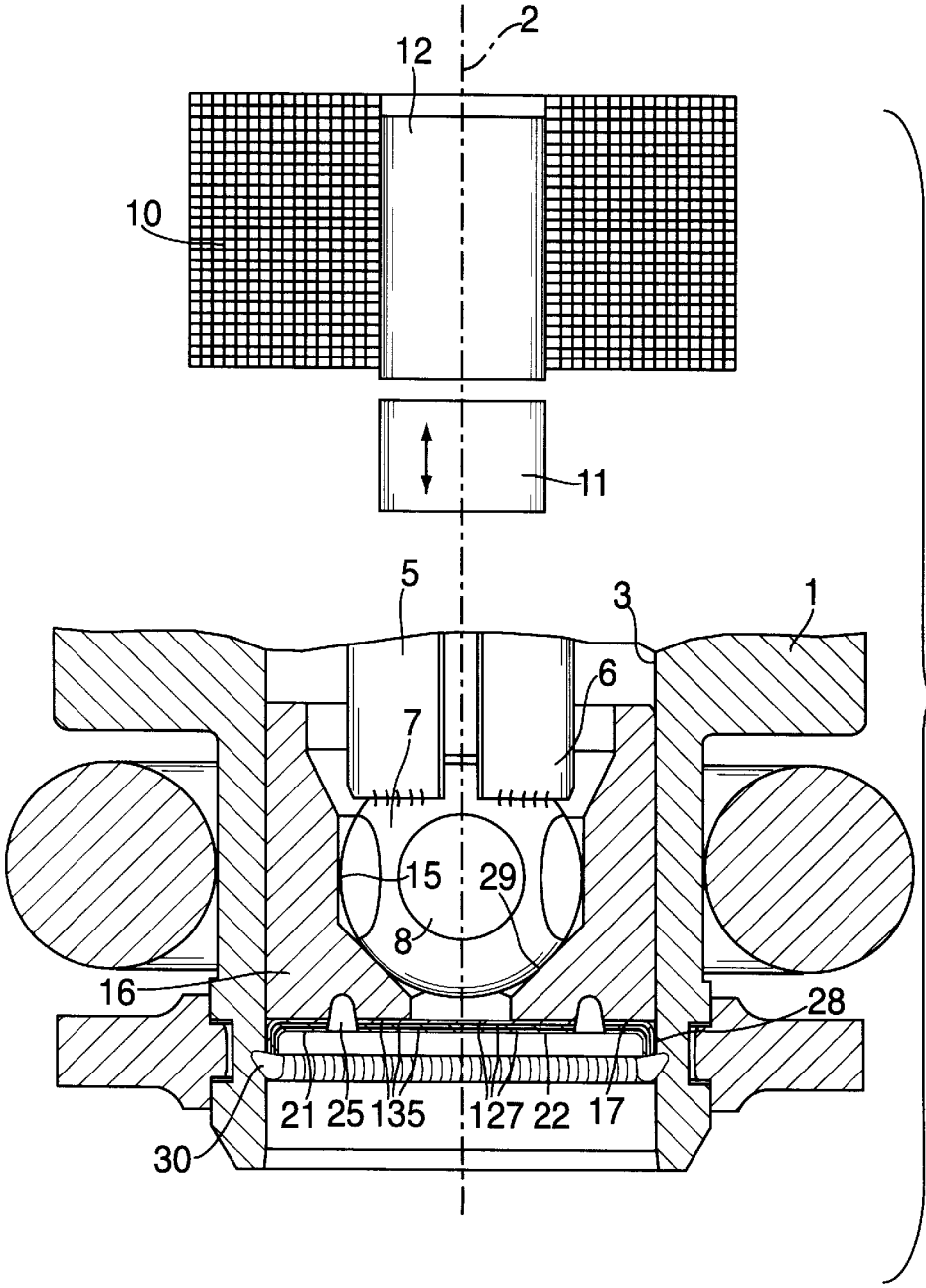
FIG. 1 partially depicts an injection valve having a first orifice disk manufactured according to the present invention.

FIG. 1 partially depicts, as an exemplary embodiment for use of an orifice disk manufactured according to the present invention, a valve in the form of an injection valve for fuel injection systems of mixture-compressing, spark-ignited internal combustion engines. The injection valve has a tubular valve seat support 1 in which a longitudinal opening 3 is configured concentrically with a longitudinal valve axis 2. Arranged in longitudinal opening 3 is for example, a tubular valve needle 5 which at its downstream end 6 is joined to for example, a spherical valve closure element 7 on whose periphery, for example, five flattened areas 8 are provided for fuel to flow past.

Actuation of the valve is accomplished in known fashion, for example electromagnetically. A sketched electromagnetic circuit having a magnet coil 10, an armature 11, and a core 12 serves to move valve needle 5 axially, and thus to open the injection valve against the spring force of a return spring (not depicted) or to close it. Armature 11 is joined, by way, for example, of a weld bead produced with a laser, to the end of valve needle 5 facing away from valve closure element 7, and aligned with core 12.

A guide opening 15 of a valve seat element 16 serves to guide valve closure element 7 during axial movement. Valve seat element 16, which for example is cylindrical, is sealedly mounted by welding into the downstream end (facing away from core 12) of valve seat support 1, in longitudinal opening 3 running concentrically with longitudinal valve axis 2. At its lower end face 17 facing away from valve closure element 7, valve seat element 16 is concentrically and immovably joined to an orifice disk 21, according to the present invention or manufactured according to the present invention, the orifice disk, for example, being of cup-shaped configuration and thus resting directly on valve seat element 16 with a base part 22. Orifice disk 21 is constituted by at least two, in the exemplary embodiment according to FIG. 1 three, thin metal layers 135, so that a so-called metal laminate orifice disk is present.

Joining of valve seat element 16 and orifice disk 21 is accomplished, for example, by way of an annularly peripheral and sealed first weld bead 25 configured using a laser. This type of assembly avoids the risk of any undesired deformation of orifice disk 21 in its center region, along with opening geometry 27 provided there. Outwardly adjacent to base part 22 of cup-shaped orifice disk 21 is a peripheral retaining rim 28 which extends away from valve seat element 16 in the axial direction and is slightly bent conically outward up to its end. Retaining rim 28 exerts a radial spring effect on the wall of longitudinal opening 3. This prevents any formation of chips on longitudinal opening 3 when valve seat element 16 is inserted into longitudinal opening 3 of valve seat support 1. Retaining rim 28 of orifice disk 21 is joined at its free end to the wall of longitudinal opening 3, for example, by way of a peripheral and sealed second weld bead 30. The sealed welds prevent fuel from flowing through at undesired points in longitudinal opening 3 directly into an intake duct of the internal combustion engine.

The insertion depth into longitudinal opening 3 of the valve seat part including valve seat element 16 and cup-shaped orifice disk 21 determines the magnitude of the stroke of valve needle 5, since the one end position of valve needle 5, when magnet coil 10 is not energized, is defined by contact of valve closure element 7 against a valve seat surface 29 of valve seat element 16. The other end position of valve needle 5, when magnet coil 10 is energized, is defined, for example, by contact of armature 11 against core 12. The distance between these two end positions of valve needle 5 thus represents the stroke.

The spherical valve closure element 7 coacts with valve seat surface 29, tapering frustoconically in the flow direction, of valve seat element 16, which is configured in the axial direction between guide opening 15 and the lower end face 17 of valve seat element 16.

Figure 2:
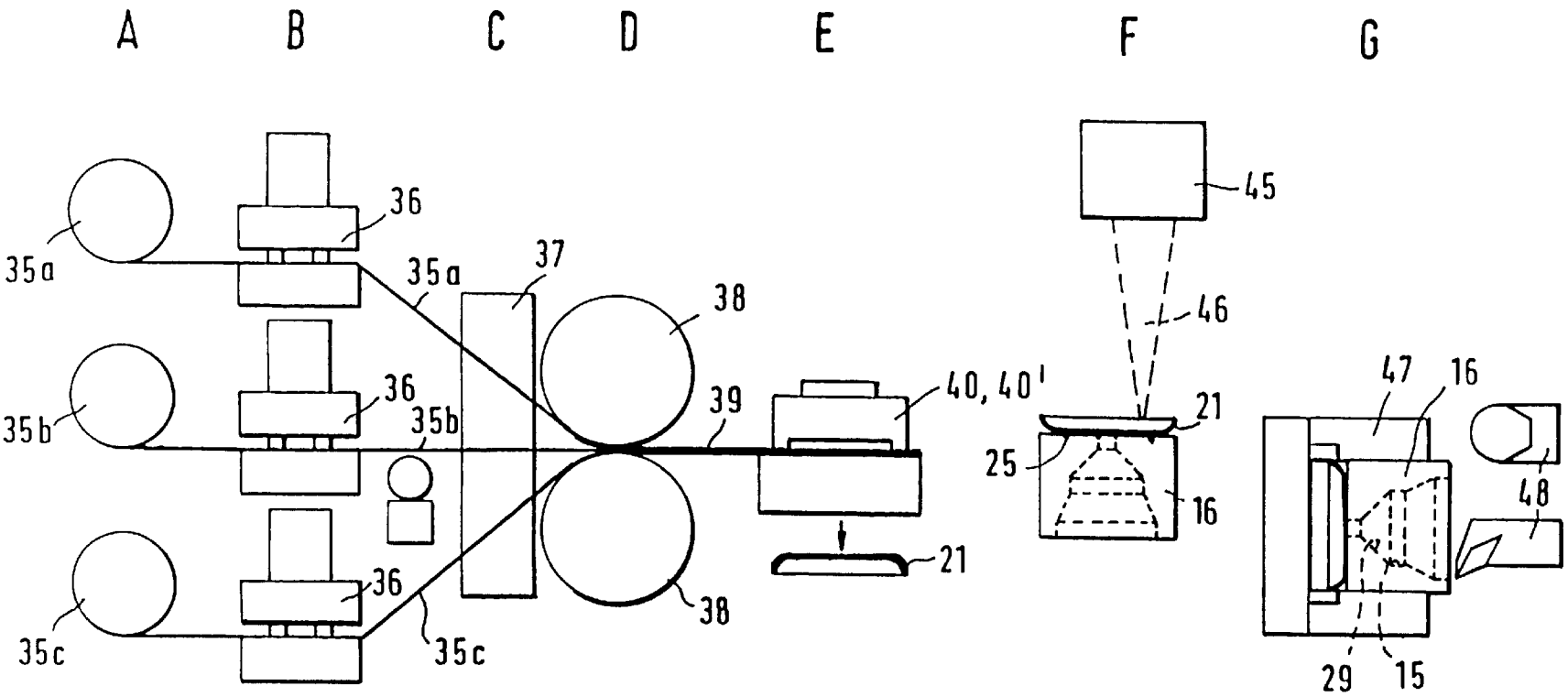
FIG. 2 is a schematic diagram of the process sequence for manufacturing an orifice disk with stations A through E, and for mounting an orifice disk in an injection valve with stations F and G.

FIG. 2 shows a schematic diagram of the process sequence for manufacture of an orifice disk 21 according to the present invention, the individual production and processing stations being depicted merely schematically. Individual processing steps will be explained in more detail with reference to the subsequent FIGS. 3 through 6. In the first station designated A, metal foils in the form, for example, of rolled-up foil strips 35, are present in accordance with the desired number of metal layers 135 of the later orifice disk 21. When three foil strips 35*a*, 35*b*, and 35*c* are used to manufacture a metal laminate orifice disk 21 including three metal layers 135, it is preferable for later processing, especially during joining, to coat middle foil strip 35*b*. Identical opening geometries 27 of orifice disk 21, and auxiliary openings for centering and aligning foil strips 35 and for later removal of orifice disks 21 from foil strips 35, are subsequently introduced into foil strips 35 in large quantities in each foil 35.

This processing of the individual foil strips 35 occurs in station B. Provided in station B are tools 36 with which the desired opening geometries 27 and auxiliary openings are shaped into the individual foil strips 35. In this context, all the essential contours are manufactured by micropunching, laser cutting, electrodischarge machining, etching, or comparable methods. Examples of such foil strips 35 processed in this fashion are illustrated by FIG. 3. Foil strips 35 processed in this fashion pass through station C, which represents a heating device 37 in which foil strips 35 are, for example, inductively heated in preparation for a soldering operation. Station C is provided only optionally, since other joining methods not requiring heating can also be used at any time to join foil strips 35.

In station D, joining of the individual foil strips 35 to one another is accomplished, foil strips 35 being accurately positioned with respect to one another with the aid of centering mechanisms, and, for example using rotating pressure rollers 38, pressed together and transported on. Laser welding, light beam welding, electron beam welding, ultrasonic welding, pressure welding, induction soldering, laser beam soldering, electron beam soldering, adhesive bonding, or other known methods can be used as joining methods. Subsequent to this, orifice disk band 39 comprising several layers of foil strips 35 is processed in station E in such a way that orifice disks 21 are present in the size and contour desired for installation in the injection valve. Isolation of orifice disks 21 takes place in station E, for example by punching them out of orifice disk band 39 with a tool 40, in particular a punching tool. Orifice disks 21 can immediately be used in an injection valve as soon as they are punched out. On the other hand, however, it is also possible to use a tool 40', in particular a deep drawing tool, to separate orifice disks 21 out of orifice disk band 39 by breaking them away or cutting them out and thus isolate them, orifice disks 21 being at the same time directly given a cup-shaped configuration. If punching is performed and a cup-shaped configuration for orifice disks 21 is desired, an additional deep drawing operation or crimping is necessary after punching.

The process steps for the manufacture of orifice disks 21 are thus complete, in that all that occurs subsequently is installation of orifice disks 21. The isolated orifice disks 21, shaped in the desired fashion, are in a subsequent process step respectively mounted on the lower end face 17 of valve seat element 16 using a joining mechanism 45, a laser welding device preferably being used to attain a solid and sealed join (station F). The annularly peripheral weld bead 25 is attained using symbolically indicated laser radiation 46. The valve seat part that now exists, made up of valve seat element 16 and orifice disk 21, is then optionally also precision machined, the valve seat part being in this context clamped in a retaining mechanism 47 (station G). The inner contours in particular of valve seat element 16 (e.g. guide opening 15, valve seat surface 29) are finish-machined using various machining tools 48 with which methods such as honing or finish-turning can be performed.

Concrete exemplary embodiments of foil strips 35 for an orifice disk 21 are shown in FIG. 3. In this, foil strip 35*a* represents upper metal layer 135*a* of orifice disk 21 which later faces toward valve closure element 7, and foil strip 35*c* represents lower metal layer 135*c* of orifice disk 21 which later faces away from valve closure element 7, while foil strip 35*b* constitutes metal layer 135*b* located between the latter two in orifice disk 21. For metal laminate orifice disks 21 manufactured according to the present invention, two to five foil strips, each having a thickness of 0.05 mm to 0.3 mm, in particular approx. 0.1 mm, are usually arranged one above another. Each foil strip 35 is equipped in station B with an opening geometry 27 which repeats in large numbers over the length of foil strip 35. In the exemplary embodiment depicted in FIG. 3, upper foil strip 35*a* has an opening geometry 27 in the form of a cross-shaped inlet opening 27*a*, middle foil strip 35*b* has an opening geometry 27 of a passthrough opening 27*b* in circular form with a greater diameter than the dimension of cross-shaped inlet opening 27*a*, and lower foil strip 35*c* has an opening geometry 27 in the form of four circular spray openings 27*c* located in the coverage region of passthrough opening 27*b*. Further auxiliary openings 49, 50 are introduced in station B in addition to these opening geometries 27.

Between each two opening geometries 27 that are introduced, auxiliary openings 49 are indented at equal distances along the two respective foil edges 52 as centering recesses which, in accordance with the shape of the tools or auxiliaries later engaging there, can be polygonal, rounded, tapered, or beveled. Other auxiliary openings 50 are provided in foil strips 35 as sickle-shaped openings surrounding the respective opening geometries 27. The, for example, four sickle-shaped auxiliary openings 50 enclose with their inner contours a circle with a diameter of the later orifice disk 21. The circular regions in foil strips 35 enclosed by auxiliary openings 50 are referred to as rounds 53. Auxiliary openings 50 taper to a point at their ends, narrow webs 55 being formed between the individual auxiliary openings 50 and possessing, in a region of the round diameter, a width of only 0.2 to 0.3 mm. Webs 55 break during punching or deep drawing in station E, causing orifice disks 21 to be detached. In particularly effective fashion, several foil strips 35 can also be combined into a larger foil carpet, on which rounds 53 are arranged in two dimensions.

FIG. 4 schematically shows an orifice disk band 39 in station D, placement of foil strips 35 onto one another being depicted in staged fashion. Beginning at the left, only lower foil strip 35*c* is initially present, onto which middle foil strip 35*b* then arrives. Upper foil strip 35*a* completes orifice disk band 39, which thus exists in three layers in the two right-hand rounds 53. It is evident from the plan view of rounds 53 that spray openings 27*c* are arranged at an offset from inlet opening 27*a*, so that a medium, for example fuel, flowing through orifice disk 21 experiences a so-called S-bend within orifice disk 21, which contributes to an improvement in atomization. A centering mechanism 57 (index pins, index pegs) engages into auxiliary openings 49, ensuring that rounds 53 of the individual foil strips 35 are brought onto one another in dimensionally accurate and positionally secure fashion before foil strips 35 are joined to one another. Auxiliary openings 49 can also be used as feed grooves for automatic transport of foil strips 35 or of orifice disk band 39. The permanent joins between foil strips 35, by welding, soldering, or adhesive bonding, can be performed both in the region of rounds 53 and outside rounds 53 near foil edges 52 or in central regions 58 between each two opposite auxiliary openings 49.

Figure 5:
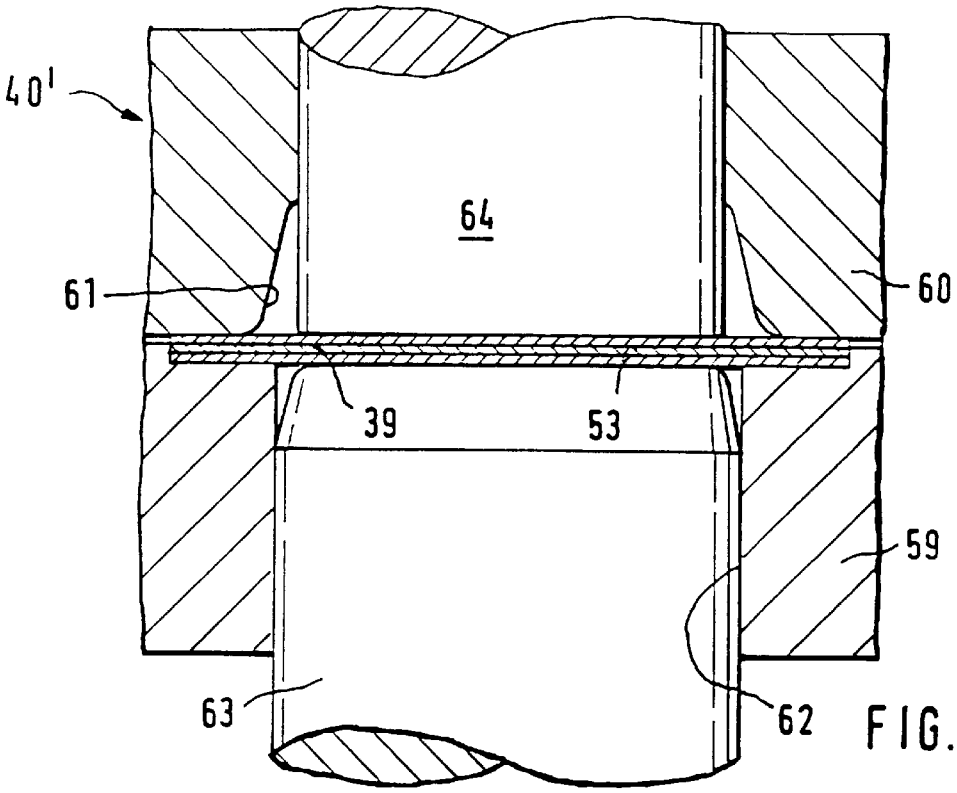
FIG. 5 shows a deep drawing tool with an orifice disk strip to be processed.
Figure 6:
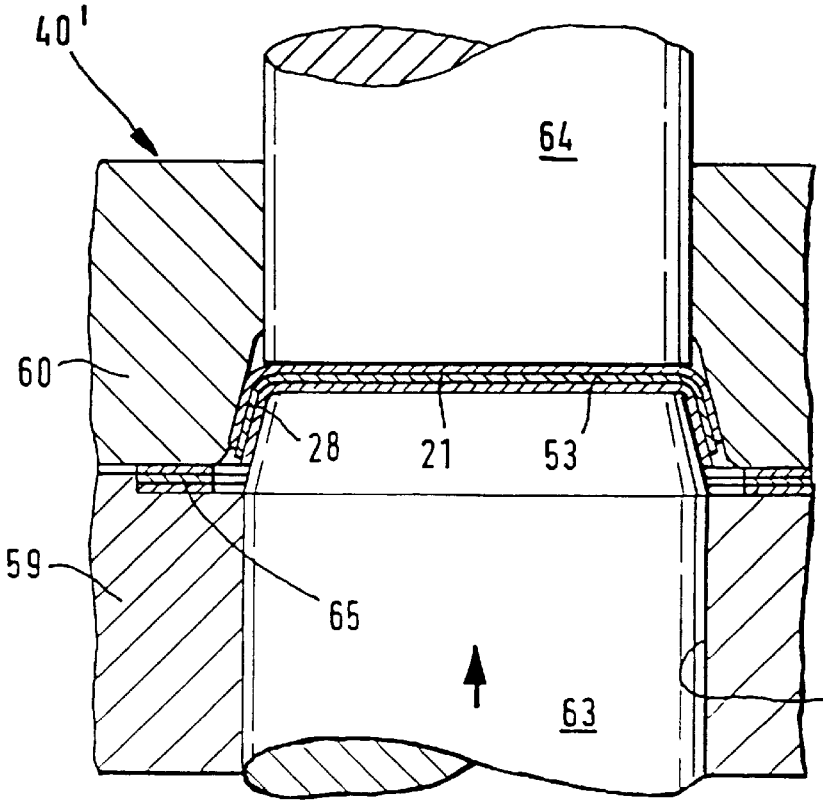
FIG. 6 shows the deep drawing tool with an orifice disk strip to be processed.

FIGS. 5 and 6 schematically depict deep drawing tool 40' through which orifice disk band 39 passes. Orifice disk band 39 rests, with its edge regions between auxiliary openings 50 and foil edges 52, for example on a workpiece support surface 59, against which it is pressed by a holddown 60. Holddown 60 has an at least partially frustoconical opening 61 which performs a die function to form retaining rim 28 of orifice disk 21. Also provided in workpiece support surface 59 is an opening 62 that is of cylindrical configuration and in which a punch 63 can be moved perpendicular to the plane of orifice disk band 39. On the side of orifice disk band 39 located opposite punch 63, there is provided in opening 61 of holddown 60 a punch counterelement 64 which follows the movement of punch but thereby defines the contour of base part 22 of orifice disk 21. The force applied by punch 63 onto round 53, which is greater than the counterforce of punch counterelement 64, causes round 53 to break away from orifice disk band 39 in the region of webs 55, and causes round 53 to deform into a cup-shaped orifice disk 21. This process taking place in station E is a translational compression-tension forming operation, such as deep drawing or cupping.

A foil edge 65 broken off from round 53 remains behind in deep drawing tool 40' as waste, but it is recycled and can be used for the manufacture of new metal foils. Permanent joining of foil strips 35 in station D can be completely dispensed with if deep drawing or cupping in station E generates retaining rim 28 of orifice disk 21 almost perpendicular to base part 22, i.e. thereby creating a sufficiently permanent join in the bending region. If a flatter angle is defined by opening 61 in holddown 60, permanent joining should in all cases be accomplished in station D. It is also necessary to apply permanent joins if flat orifice disks 21, which are separated out from orifice disk band 39 for example by punching, are desired.

Figure 6A:
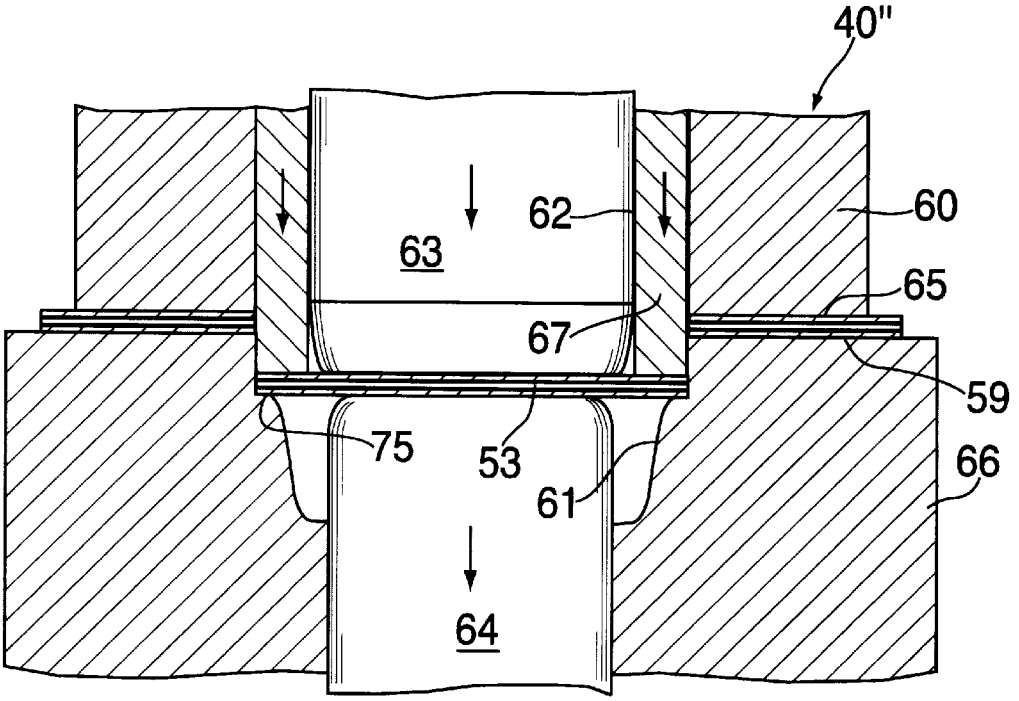
FIG. 6*a* shows a second embodiment of a deep drawing tool.

FIG. 6*a* depicts a second embodiment of a deep drawing tool 40", parts having the same effect as compared with deep drawing tool 40' shown in FIGS. 5 and 6 being labeled with the same reference characters. In deep drawing tool 40", in one operation round 53 is first cut out and is immediately thereafter deep-drawn. For this purpose, punch 63 is surrounded by a sleeve-shaped cutting tool 67 which with its inner wall defines opening 62. Together with punch 63, cutting tool 67 moves perpendicular to the plane of orifice disk band 39, as indicated by the arrows. Because of the accurately centered and defined movement of punch 63 and cutting tool 67 toward punch counterelement 64, also axially movable, in opening 61 of a die 66, round 53 is cut very accurately out of orifice disk band 39 by a cutting edge of cutting tool 67. Cutting tool 67 comes to a halt at a step 75 of opening 61 in die 66, simultaneously providing immobilization of round 53. All that then occurs is that punch 63 moves into opening 61 so that because of the partially frustoconical configuration of opening 61, round 53 is brought into a cup shape.

Figure 7:
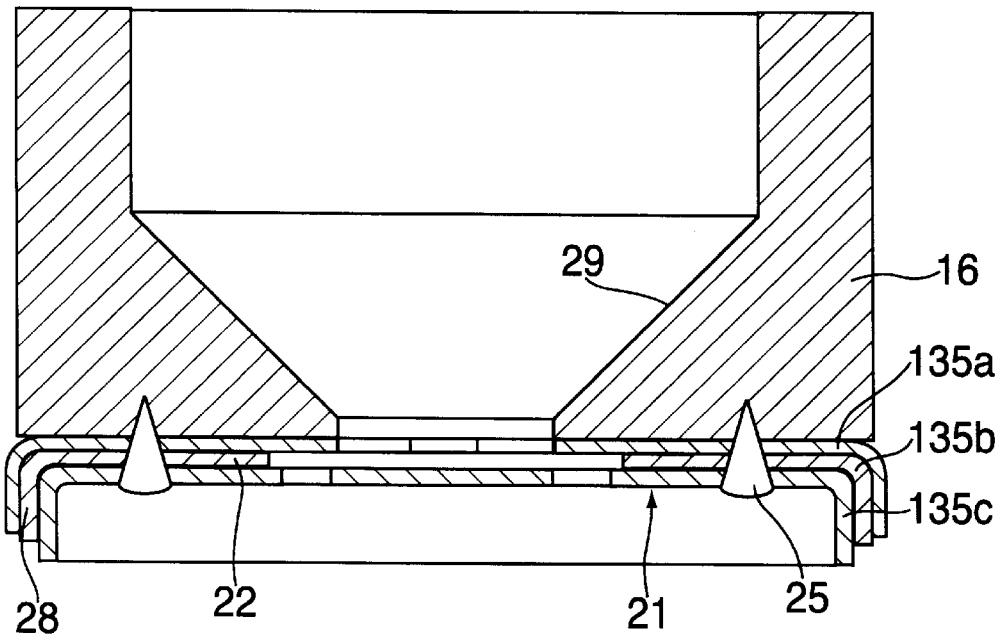
FIG. 7 shows a first example of a deep-drawn orifice disk mounted on a valve seat element.

FIGS. 7 through 9 elucidate various exemplary embodiments of valve seat parts, constituted by valve seat element 16 and orifice disk 21, arriving from station F. Deep drawing or cupping of rounds 53 in station E bends the outer edge of the round, constituting the later retaining rim 28 of orifice disk 21, out of the plane of orifice disk band 39. As FIGS. 6 through 9 show, retaining rim 28 can, after leaving deep drawing tool 40', extend, for example, almost perpendicular to the plane of base part 22. During the processing of foil strips 35 in station B, the introduction of auxiliary openings 50 has already defined the diameter of rounds 53.

If the round diameters in the individual foil strips 35 are selected to be of equal size, deep drawing of metal layers 135 then creates a retaining rim 28 which is set back at its free end which faces away from base part 22 (FIG. 7). Inner metal layer 135*c* of retaining rim 28, which proceeds from the lower foil strip 35*c*, terminates, viewed in the downstream direction, farthest away from base part 22, while all the other metal layers 135, from inside to outside, each end up shorter as a result of the deep drawing process. If, however, the diameter of rounds 53 in the upper foil strip 35*a* is defined as being larger than the diameter of rounds 53 in middle foil strip 35*b*, and in turn greater than the diameter of rounds 53 in lower foil strip 35*c*, then retaining rim 28 can on the one hand have at its free end a setback of metal layers 135 in the opposite direction from the example according to FIG. 7 (FIG. 8), or on the other hand can possess one free end at which all metal layers 135 end in one plane (FIG. 9). Selection of identical or differing round diameters is of interest in particular for the application of weld bead 30 on retaining rim 28.

Figure 10:
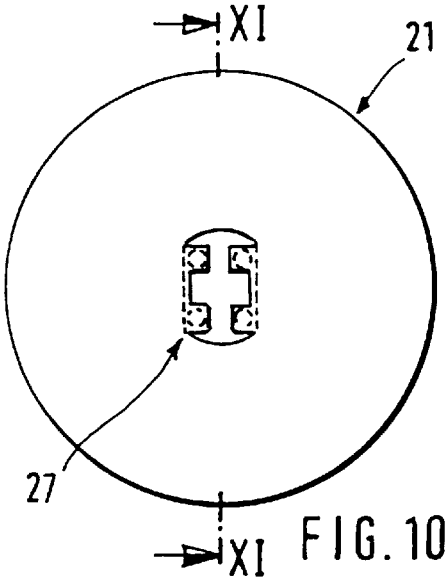
FIG. 10 shows a plan view of a further orifice disk.
Figure 11:
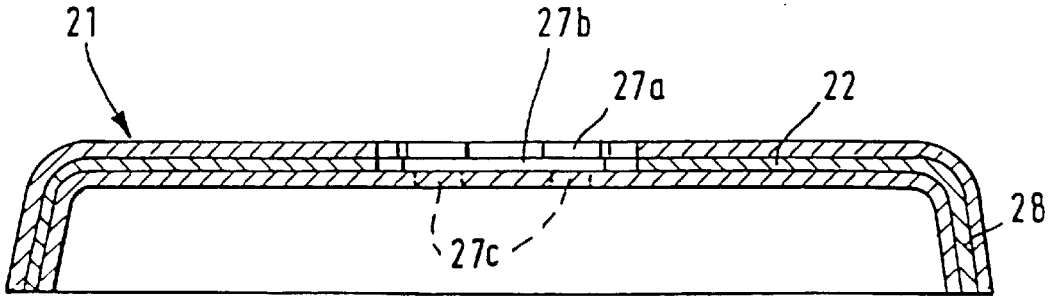
FIG. 11 shows an orifice disk in section along XI—XI of FIG. 10.
Figure 12:
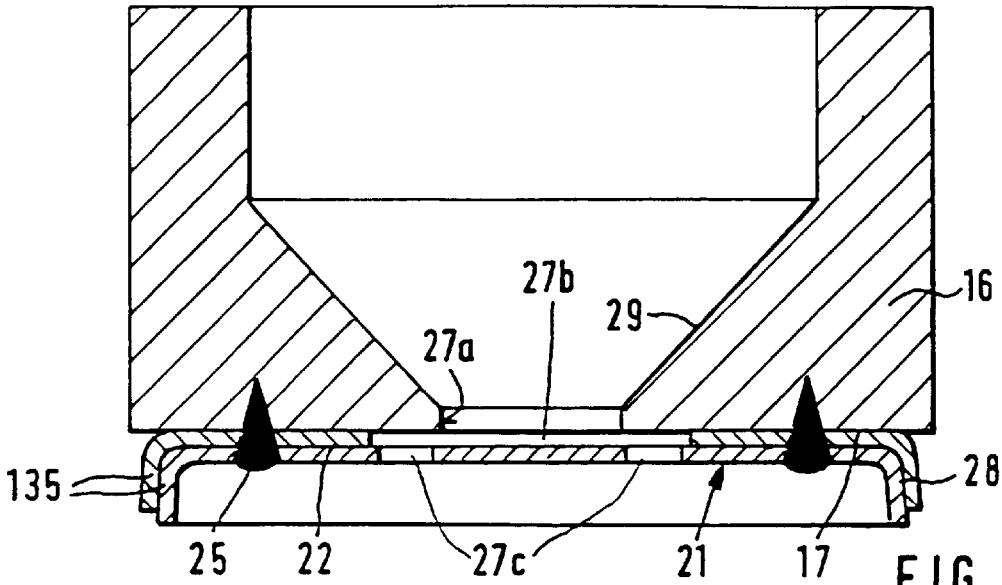
FIG. 12 shows a fourth example of a deep-drawn (two-layer) orifice disk mounted on a valve seat element.

In addition to opening geometries 27 in foil strips 35 and orifice disks 21 depicted as examples in FIGS. 3 and 4, innumerable other opening geometries 27 for metal laminate orifice disks 21 (e.g. round, elliptical, polygonal, T-shaped, sickle-shaped, cross-shaped, semicircular, parabolic, bone-shaped, or asymmetrical) are also conceivable. FIGS. 10 and 11 show a preferred exemplary embodiment of opening geometries 27 in the individual metal layers 135 of an orifice disk 21, FIG. 10 showing a plan view of orifice disk 21. FIG. 11 in particular, which is a sectioned depiction along a line XI—XI in FIG. 10, once again elucidates the configuration of orifice disk 21 with its three metal layers 135.

Upper metal layer 135*a* (FIG. 10*a*) has an inlet opening 27*a* with the largest possible circumference, possessing a contour similar to that of a stylized bat (or a double-H). Inlet opening 27*a* possesses a cross section that can be described as a partially rounded rectangle having two mutually opposite rectangular constrictions 68 and thus three inlet regions 69 which in turn project beyond constrictions 68. The three inlet regions 69 represent, with reference to the contour comparable to that of a bat, the body and the two wings of the bat (or the crosspieces to the longitudinal bar of the double-H). Four circular spray openings 27*c*, for example each at the same spacing from the center axis of orifice disk 21 and also, for example, arranged symmetrically about it, are provided in lower metal layer 135*c* (FIG. 10*c*).

When all metal layers 135 are projected into one plane (FIG. 2), spray openings 27*c* lie partially or largely in constrictions 68 of upper metal layer 135*a*. Spray openings 27*c* are located at an offset from inlet opening 27*a*, i.e. in the projection, inlet opening 27*a* will not overlap spray openings 27*c* at any point. The offset can, however, be of different magnitudes in different directions.

In order to guarantee fluid flow from inlet opening 27*a* to spray openings 27*c*, a passthrough opening 27*b* is configured in middle metal layer 135*b* (FIG. 10*b*) as a cavity. Passthrough opening 27*b*, having a contour of a rounded rectangle, has a size such that in projection, it completely overlaps inlet opening 27*a*, and in particular projects beyond inlet opening 27*a* in the regions of constrictions 68, i.e. has a greater spacing from the center axis of orifice disk 21 than constrictions 68.

Figure 10A:
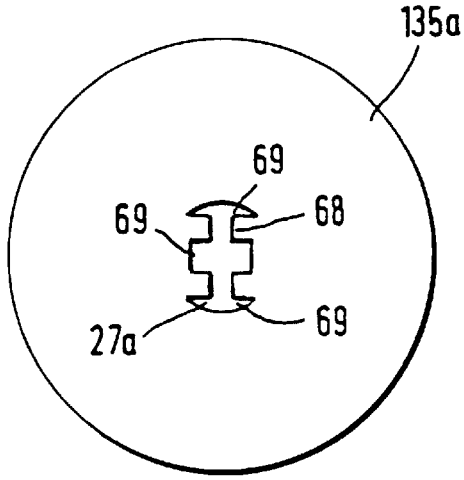
FIGS. 10*a*–10*c* show individual metal layers of the orifice disk illustrated in FIG. 10.
Figure 10B:
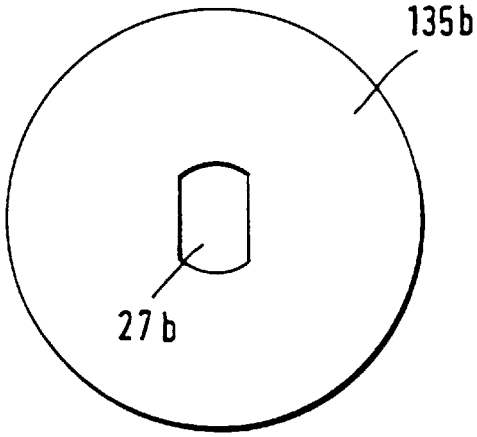
Figure 10C:
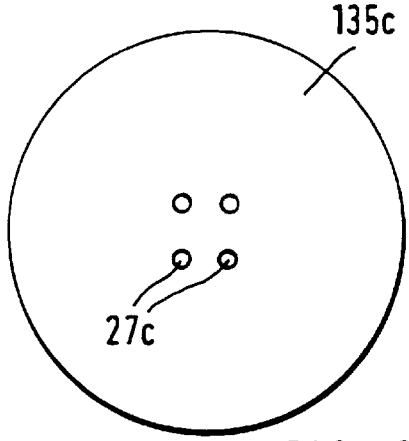

In FIGS. 10*a*, 10*b*, and 10*c*, metal layers 135*a*, 135*b*, and 135*c*, in their condition as a composite orifice disk separated out from foil strips 35 prior to deep drawing, are once again depicted individually in order to elucidate precisely the opening geometry 27 of each individual metal layer 135. Each individual Figure is ultimately a simplified sectioned depiction horizontally through orifice disk band 39 along each metal layer 135*a*, 135*b*, and 135*c*. In order better to elucidate opening geometries 27, crosshatching and the physical edges of the other metal layers 135 have been omitted.

FIGS. 12 through 15 show exemplary embodiments of two orifice disks 21, having metal layers 135, which are mounted on a valve seat element 16 of an injection valve by way of a sealed weld bead 25. Valve seat element 16 has, downstream from valve seat surface 29, an outlet opening which, compared with orifice disk 21 having the three metal layers 135, already represents inlet opening 27*a*. With its lower outlet opening 27*a*, valve seat element 16 is shaped in such a way that its lower end face 17 partially forms an upper covering for passthrough opening 27*b*, and thus defines the inlet area for fuel into orifice disk 21. In all of the exemplary embodiments depicted in FIGS. 12 through 15, outlet opening 27*a* has a diameter smaller than the diameter of an imaginary circle on which spray openings 27*c* of orifice disk 21 lie. In other words, there is a complete offset between outlet opening 28*a* defining the inlet of orifice disk 21, and spray openings 27*c*. When valve seat element 16 is projected onto orifice disk 21, valve seat element 16 covers all spray openings 27*c*. Because of the radial offset of spray openings 27*c* with respect to outlet opening 27*a*, an S-shaped flow profile for the medium, e.g. the fuel, results. An S-shaped flow profile is also attained even if valve seat element 16 only partially covers all spray openings 27*c* in orifice disk 21.

Because of the so-called S-bend inside orifice disk 21, with several extreme flow deflections, a high level of atomization-promoting turbulence is impressed upon the flow. The velocity gradient transverse to the flow is thereby particularly pronounced. It is an expression of the change in velocity transverse to the flow, the velocity in the center of the flow being much higher than in the vicinity of the walls. The elevated shear stresses in the fluid resulting from the velocity differences promote breakdown into fine droplets close to spray openings 27*c*. Since the flow is detached on one side due to the impressed radial component, it experiences no flow calming due to the lack of contour guidance. The fluid has a particularly high velocity at the detached side. The atomization-promoting shear turbulence is thus not abolished at the outlet.

Among the results of the transverse momentum transverse to the flow that is present due to the turbulence is the fact that the droplet distribution density in the emitted spray is highly uniform. This results in a decreased probability of droplet coagulation, i.e. the combination of small droplets into larger droplets. The consequence of the advantageous reduction of the average droplet diameter in the spray is a relatively homogeneous spray distribution. The S-bend generates in a fluid a fine-scale (high-frequency) turbulence which causes the stream to break down into correspondingly fine droplets immediately after emerging from orifice disk 21. Three examples of embodiments of opening geometry 27 in the central regions of orifice disk 21 are depicted as plan views in FIGS. 13 through 15. In these Figures, a dot-dash line symbolically indicates outlet opening 27*a* of valve seat element 16 in the region of lower end face 17, so as to elucidate the offset with respect to spray openings 27*c*. Common to all the exemplary embodiments of orifice disks 21 is the fact that they possess at least one passthrough opening 27*b* in upper metal layer 135, and at least one spray opening 27*c*, in this case four spray openings 27*c*, in lower metal layer 135, passthrough openings 27*b* being in each case of such magnitude in terms of their width or breadth that complete flow occurs through all spray openings 27*c*. This means that none of the walls which delimit passthrough openings 27*b* covers spray openings 27*c*.

Figure 13:
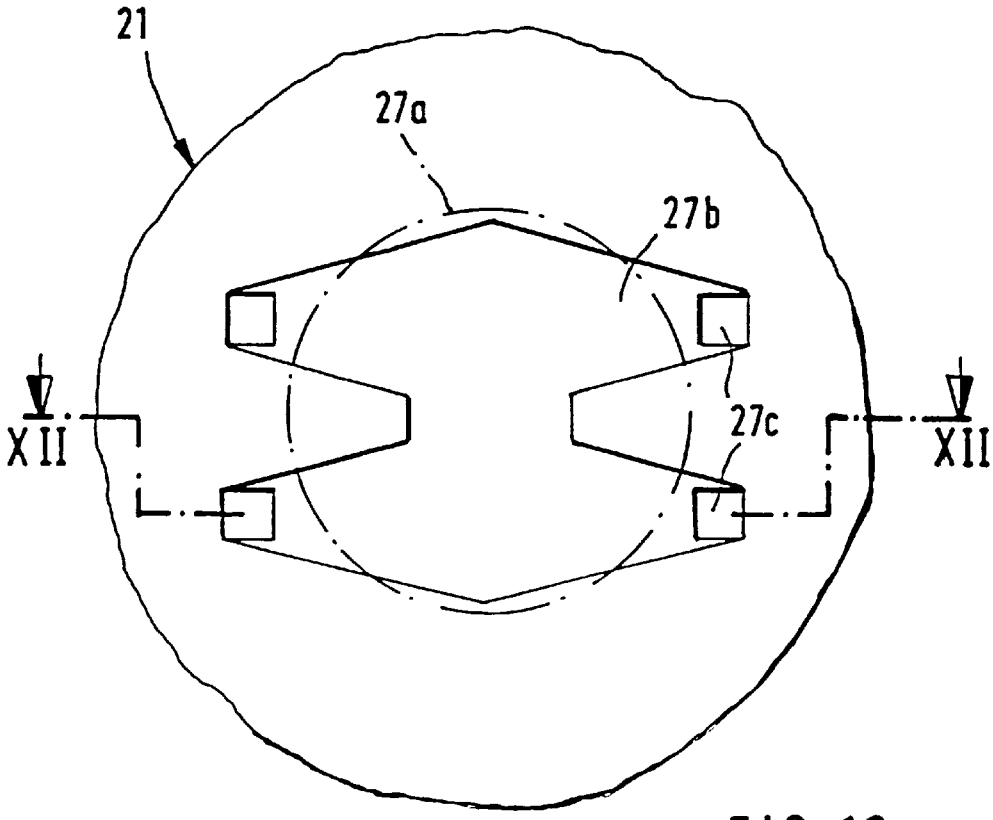
FIG. 13 shows a first central region of an orifice disk having an exemplary opening geometry.
Figure 14:
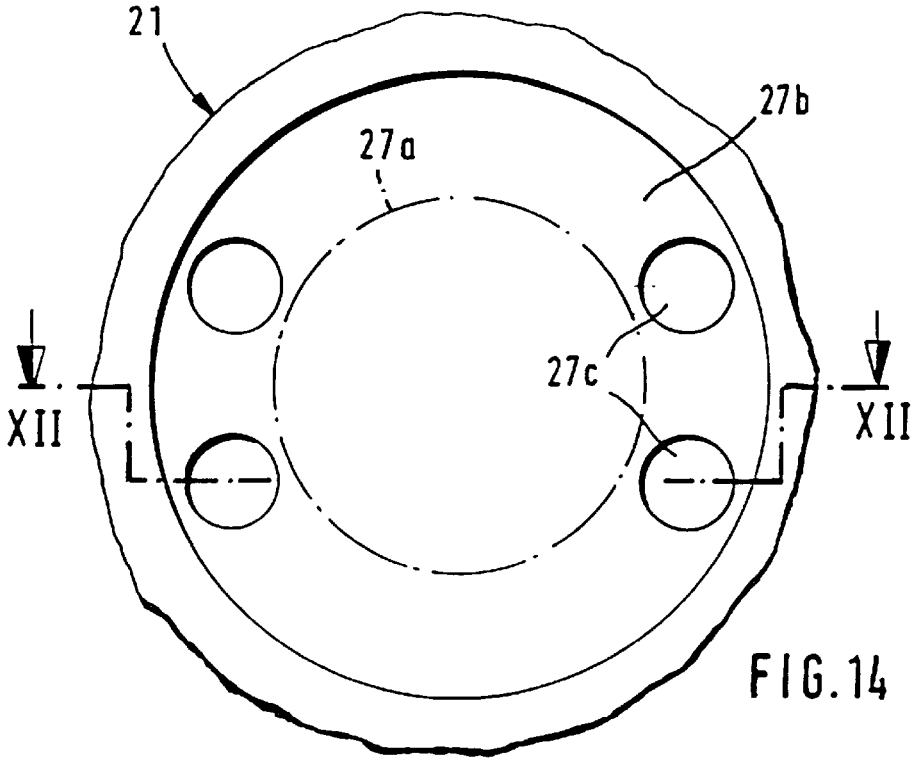
FIG. 14 shows a second central region of an orifice disk having an exemplary opening geometry.
Figure 15:
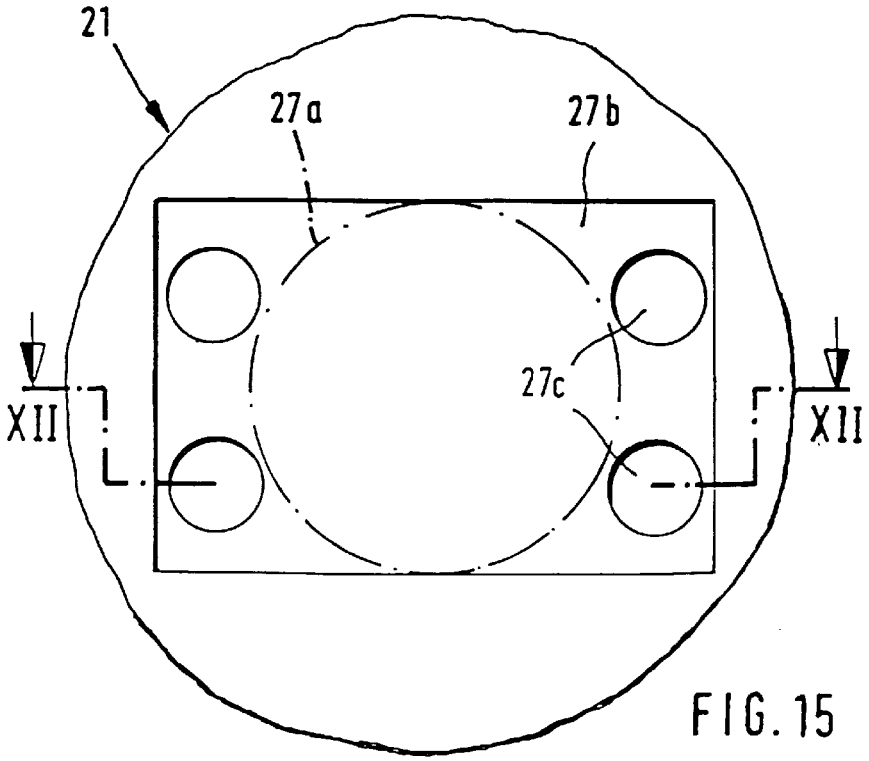
FIG. 15 shows a third central region of an orifice disk having an exemplary opening geometry.

In the case of orifice disk 21 shown partially in FIG. 13, passthrough opening 27*b* is configured in a shape similar to a double rhombus, the two rhombi being joined by a central region so that only a single passthrough opening 27*b* is present. Two or more passthrough openings 27*b* are, however, equally conceivable. Proceeding from double-rhombus passthrough opening 27*b*, four spray openings 27*c*, for example possessing square cross sections, pass through lower metal layer 135, and when viewed from the center point of orifice disk 21, are configured, for example, at the outermost points of passthrough opening 27*b*. Because of the elongated rhombi of passthrough opening 27*b*, each two spray openings 27*c* constitute an opening pair. This kind of arrangement of spray openings 27*c* makes possible a two-stream or flat-stream spray pattern.

In the other exemplary embodiments, passthrough opening 27*b* is circular (FIG. 14) or rectangular (FIG. 15), with spray openings 27*c* with circular cross sections (FIGS. 14 and 15) proceeding from it. These orifice disks 21 are also particularly suitable for two-stream spraying because of the arrangement of two spray openings 27*c* at a greater distance from two further spray openings 27*c*.

What is claimed is:

1. A method for manufacturing an orifice disk for an injection valve, comprising the steps of:

providing at least two thin metal foils, the at least two thin metal foils having a form of one of foil strips and foil carpets;

introducing opening geometries into each of the at least two thin metal foils, the opening geometries including orifice openings and auxiliary openings;

superimposing the at least two metal foils on each other using a centering mechanism;

joining the at least two thin metal foils using a joining method to create an orifice disk band, the orifice disk band including a plurality of rounds; and isolating the plurality of rounds from the orifice disk band.

2. The method according to claim 1, wherein the providing step includes the step of providing the at least two thin metal foils in a rolled-up form.

3. The method according to claim 1, wherein the introducing step includes the step of:

performing one of punching, laser-cutting, electrodischarge machining, and etching to introduce the opening geometries into each of the at least two thin metal foils.

4. The method according to claim 3, further comprising the step of:

engaging the centering mechanism into the auxiliary openings to center and align the at least two thin metal foils, the auxiliary openings being provided at regular intervals on edges of the at least two thin metal foils.

5. The method according to claim 3, further comprising the step of:

introducing sickle-shaped auxiliary openings into the at least two thin metal foils, inner boundaries of the sickle-shaped auxiliary openings defining a diameter of the rounds.

6. The method according to claim 5, wherein the sickle-shaped auxiliary openings include pointed ends, further comprising the step of:

arranging the pointed ends to form narrow webs of approximately 0.2 to 0.3 mm between the pointed ends.

7. The method according to claim 1, further comprising the step of:

passing the at least two thin metal foils through a heating device before the joining step.

8. The method according to claim 1, wherein the joining step includes performing one of welding, soldering, and adhesive bonding.

9. The method according to claim 1, wherein the isolating step includes one of punching and cutting out.

10. A method for manufacturing an orifice disk for an injection valve, comprising the steps of:

providing at least two thin metal foils, the at least two thin metal foils having a form of one of foil strips and foil carpets;

introducing opening geometries into each of the at least two thin metal foils, the opening geometries including orifice openings and auxiliary openings;

superimposing the at least two metal foils on each other using a centering mechanism;

joining the at least two thin metal foils using a joining method to create an orifice disk band, the orifice disk band including a plurality of rounds; and performing one of deep-drawing and cupping the rounds to form cup-shaped orifice disks, the orifice disks being isolated from the orifice disk band.

11. The method according to claim 10, wherein the providing step includes the step of providing the at least two thin metal foils in a rolled-up form.

12. The method according to claim 10, wherein the introducing step includes the step of:

performing one of punching, laser-cutting, electrodischarge machining, and etching to introduce the opening geometries into each of the at least two thin metal foils.

13. The method according to claim 12, further comprising the step of:

engaging the centering mechanism into the auxiliary openings to center and align the at least two thin metal foils, the auxiliary openings being provided at regular intervals on edges of the at least two thin metal foils.

14. The method according to claim 12, further comprising the step of:

introducing sickle-shaped auxiliary openings into the at least two thin metal foils, inner boundaries of the sickle-shaped auxiliary openings defining a diameter of the rounds.

15. The method according to claim 14, wherein the sickle-shaped auxiliary openings include pointed ends, further comprising the step of:

arranging the pointed ends to form narrow webs of approximately 0.2 to 0.3 mm between the pointed ends.

16. A method for manufacturing an orifice disk for an injection valve, comprising the steps of:

providing at least two thin metal foils, the at least two thin metal foils having a form of one of foil strips and foil carpets;

introducing opening geometries into each of the at least two thin metal foils, the opening geometries including orifice openings and auxiliary openings;

superimposing the at least two metal foils on each other using a centering mechanism; and performing one of deep-drawing and cupping the rounds to form cup-shaped orifice disks, the orifice disks being isolated from orifice disk bands.

17. The method according to claim 16, wherein the providing step includes the step of providing the at least two thin metal foils in a rolled-up form.

18. The method according to claim 16, wherein the introducing step includes the step of:

performing one of punching, laser-cutting, electrodischarge machining, and etching to introduce the opening geometries into each of the at least two thin metal foils.

19. The method according to claim 18, further comprising the step of:

engaging the centering mechanism into the auxiliary openings to center and align the at least two thin metal foils, the auxiliary openings being provided at regular intervals on edges of the at least two thin metal foils.

20. The method according to claim 18, further comprising the step of:

introducing sickle-shaped auxiliary openings into the at least two thin metal foils, inner boundaries of the sickle-shaped auxiliary openings defining a diameter of the rounds.

21. The method according to claim 20, wherein the sickle-shaped auxiliary openings include pointed ends, further comprising the step of:

arranging the pointed ends to form narrow webs of approximately 0.2 to 0.3 mm between the pointed ends.

22. The method according to claim 16, wherein the step of performing one of deep-drawing and cupping is accomplished using a deep drawing tool and a movable punch in coaction with a die and includes the step of deforming the rounds into the orifice disks, the orifice disks having a base part and a retaining rim, the retaining rim being bent away from the base part.

23. The method according to claim 22, wherein during the step of performing one of deep-drawing and cupping, the rounds are isolated from the orifice disk ban by breaking narrow webs between auxiliary openings, the auxiliary openings defining diameters of the rounds.

24. The method according to claim 23, further comprising the step of:

after the isolating step, sealedly attaching at least one of the orifice disks to a valve seat element of the injection valve.

25. An orifice disk for an injection valve, the orifice disk comprising:

at least two metal layers arranged in a sandwich fashion, each metal layer having an opening geometry which allows a medium to flow completely through the orifice disk through all of the at least two metal layers, each metal layer being formed of a metal foil, and each metal layer being immovably joined to each adjacent metal layer.

26. An orifice disk for an injection valve, comprising:

at least two metal layers arranged in a sandwich fashion, each metal layer having an opening geometry which allows a medium to flow completely through the orifice disk through all of the at least two metal layers, the at least two metal layers being immovably joined to one another, wherein each of the at least two metal layers includes a flat base part, the flat base part having the opening geometry, an annularly peripheral bent-over retaining rim extending from the flat base part.

27. The orifice disk according to claim 26, wherein the retaining rim is bent over at an angle of approximately 90° from the base part.

28. The orifice disk according to claim 26, wherein the base part and the retaining rim of each of the at least two layers form a cup-shaped configuration, the cup-shaped configuration being formed by one of deep drawing and cupping.

29. An injection valve for a fuel injection system of an internal combustion engine, the injection valve comprising:

a valve seat element including an immovable valve seat;

a valve closure element coacting with the valve seat, the valve closure element being axially movable along a longitudinal axis of the injection valve; and an orifice disk arranged downstream from the valve seat, the orifice disk including at least two metal layers each having a different opening geometry, each of the at least two metal layers being formed of a metal foil, each of the at least two metal layers being immovably joined to each adjacent metal layer, a lower end face of the valve seat element at least partially directly covering the opening geometry of an upper one of the at least two metal layers facing the valve seat element, at least one spray opening of the opening geometry of a lower one of the at least two metal layers being covered by the valve seat element, the lower one of the at least two metal layers being one of the at least two metal layers farthest away from the valve seat element.

30. An injection valve for a fuel injection system of an internal combustion engine, comprising:

a valve seat element including an immovable valve seat;

a valve closure element coacting with the valve seat, the valve closure element being axially movable alone a longitudinal axis of the injection valve; and an orifice disk arranged downstream from the valve seat, the orifice disk including at least two metal layers each having a different opening geometry, the at least two metal layers being immovably joined to one another, a lower end face of the valve seat element at least partially directly covering the opening geometry of an upper one of the at least two metal layers facing the valve seat element, at least one spray opening of the opening geometry of a lower one of the at least two metal layers being covered by the valve seat element, the lower one of the at least two metal layers being one of the at least two metal layers farthest away from the valve seat element, wherein the upper one of the at least two metal layers has a passthrough opening, and the lower one of the at least two metal layers has at least two spray openings.

31. The injection valve according to claim 30, wherein the passthrough opening has a larger cross section that each of the at least two spray openings.

32. The injection valve according to claim 31, wherein none of the at least two spray openings is covered by a wall of the passthrough opening.

33. An injection valve for a fuel injection system of an internal combustion engine, comprising:

a valve seat element including an immovable valve seat;

a valve closure element coacting with the valve seat, the valve closure element being axially movable along a longitudinal axis of the injection valve; and an orifice disk arranged downstream from the valve seat, the orifice disk including at least two metal layers each having a different opening geometry, the at least two metal layers being immovably joined to one another, a lower end face of the valve seat element at least partially directly covering the opening geometry of an upper one of the at least two metal layers facing the valve seat element, at least one spray opening of the opening geometry of a lower one of the at least two metal layers being covered by the valve seat element, the lower one of the at least two metal layers being one of the at least two metal layers farthest away from the valve seat element, wherein the orifice disk includes a plurality of passthrough openings and an equal number of spray openings so that exactly one spray opening proceeds from each of the plurality of passthrough openings.

34. An orifice disk for an injection valve, comprising:

at least two sheet-metal plies arranged in a sandwich fashion, each sheet-metal ply having an opening geometry which allows a medium to flow completely through the orifice disk through all of the at least two sheet-metal plies, each of the two sheet-metal plies being produced independently, and the at least two sheet-metal plies being immovably joined to one another after having been produced independently.

35. An orifice disk of an injection valve, comprising:

at least two metal layers arranged in a sandwich fashion, each metal layer having an opening geometry which allows a medium to flow completely through the orifice disk through all of the at least two metal layers, wherein each of the at least two metal layers includes a flat base part, the flat base part having the opening geometry, an annularly peripheral bent-over retaining rim extending from the flat base part.

36. The orifice disk according to claim 35, wherein the retaining rim is bent over at an angle of approximately 90° from the base part.

37. The orifice disk according to claim 35, wherein the base part and the retaining rim of each of the at least two layers form a cup-shaped configuration, the cup-shaped configuration being formed by one of deep drawing and cupping.

38. An injection valve for a fuel injection system of an internal combustion engine, comprising:

a valve seat element including an immovable valve seat;

a valve closure element coacting with the valve seat, the valve closure element being axially movable along a longitudinal axis of the injection valve; and an orifice disk arranged downstream from the valve seat, the orifice disk including at least two sheet-metal plies each having a different opening geometry, each of the at least two sheet-metal plies being independently produced, and the at least two sheet-metal plies being immovably joined to one another after having been independently produced, a lower end face of the valve seat element at least partially directly covering the opening geometry of an upper one of the at least two sheet-metal plies facing the valve seat element, at least one spray opening of the opening geometry of a lower one of the at least two sheet-metal plies being covered by the valve seat element, the lower one of the at least two sheet-metal plies being one of the at least two sheet-metal plies farthest away from the valve seat element.

* * * * *